US007759810B2

(12) United States Patent
Kumar

(10) Patent No.: US 7,759,810 B2
(45) Date of Patent: Jul. 20, 2010

(54) SYSTEM AND METHOD FOR EMERGENCY SHUTDOWN OF AN INTERNAL COMBUSTION ENGINE

(75) Inventor: Ajith Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 41 days.

(21) Appl. No.: 11/468,395

(22) Filed: Aug. 30, 2006

(65) Prior Publication Data

US 2008/0054647 A1 Mar. 6, 2008

(51) Int. Cl.
*F02D 41/30* (2006.01)
*F02M 59/20* (2006.01)

(52) U.S. Cl. ..... 290/40 R; 701/104

(58) Field of Classification Search ..... 290/40 R
See application file for complete search history.

(56) References Cited

U.S. PATENT DOCUMENTS 2,428,095 A * 9/1947 Reavis ..... 123/198 DC
3,545,421 A * 12/1970 Strader ..... 123/198 R
3,568,648 A * 3/1971 Cass ..... 123/41.15
3,743,901 A * 7/1973 Johnson ..... 318/87
3,960,011 A * 6/1976 Renz et al. ..... 73/116
4,585,983 A 4/1986 Cooper et al.
5,517,093 A * 5/1996 Augustyniak et al. ..... 318/63
5,806,011 A * 9/1998 Azzaro et al. ..... 701/99
6,023,137 A 2/2000 Kumar et al.
6,429,540 B1 8/2002 Dunsworth et al.
6,522,439 B2 2/2003 Price et al.
7,217,221 B2 * 5/2007 Sah et al. ..... 477/3
7,315,778 B1 * 1/2008 Kumar ..... 701/104

FOREIGN PATENT DOCUMENTS

GB 2294130 A * 4/1996
JP 62134397 A * 6/1987
SU 527313 A * 7/1977

* cited by examiner

*Primary Examiner*—Joseph Waks
(74) *Attorney, Agent, or Firm*—GE Global Patent Operation; John A. Kramer

(57) ABSTRACT

A method and system for rapidly shutting down an engine uses a rotating machine coupled to the engine as a dynamometer for stopping the engine. The rotating machine is controlled adaptively to maximize the power absorbed from the engine, thereby minimizing the amount of time needed to stop the engine.

16 Claims, 7 Drawing Sheets

SYSTEM AND METHOD FOR EMERGENCY SHUTDOWN OF AN INTERNAL COMBUSTION ENGINE

FIELD OF THE INVENTION

The field of the invention relates to a system and method for rapidly shutting down an internal combustion engine in the event of an abnormal operating condition.

BACKGROUND OF THE INVENTION

The need for emergency shutdown of an internal combustion engine may arise in a variety of situations. Fugitive fueling is one such situation. As used herein, the term "fugitive fueling" means the phenomenon in which an engine receives fuel in excess of that which a fuel controller intends to deliver, either by injectors or by another fuel delivery device. Fugitive fueling may occur in a variety of situations. For example, if an engine is operated in a hydrocarbon-contaminated atmosphere, such as could occur in the event of a spill at a petroleum transfer terminal or a recycling facility, sufficient unwanted, or fugitive, hydrocarbon may be inducted by the air system of an engine to cause overspeed and severe engine damage. A mishap such as a vehicular accident or train wreck may create a fugitive fueling situation, too.

Another type of fugitive fueling may occur due to a leak in an engine lubrication system. Such a leak may occur in a turbocharger or other component connected with the engine's air inlet system. Those skilled in the art will appreciate that engines, particularly diesel engines, are capable of operating quite well on lubricating oil, including lubricating oil aspirated into the engine's cylinders as a result of leaking turbocharger seals or even worn valve guides. Yet another type of fugitive fueling may occur if a fuel system injector is severely impaired such that the injector either flows more than it is intended to flow, or simply leaks. These sorts of impairment will most likely occur with an unthrottled engine having fuel injection, but could occur with a carbureted engine as well.

U.S. Pat. Nos. 6,429,540 and 6,522,439, which are assigned to the assignee of the present invention, address methods for responding to an engine overspeed condition resulting from ingestion of lube oil into an engine's cylinders.

Emergency shutdown may be indicated for reasons other than fugitive fueling. For example, engine overspeeding due to a loss of governor control, or excessive vibration resulting from mechanical faults, or overtemperature, or loss of oil pressure due to leaks or oil pump impairment, all militate in favor of emergency shutdown.

A need therefore exists for a system employing a direct-coupled rotating electrical machine to rapidly stop an engine if an emergency condition occurs.

BRIEF DESCRIPTION OF THE INVENTION

The various embodiments of the present quick shutdown system are useful for responding to fugitive fueling of an internal combustion engine. In a first embodiment, a controller, which is operatively connected with the engine's fuel supply system and with an engine output measuring device, predicts the quantity of fuel which the engine should consume during a period of time, based upon the engine's work output. The controller compares either the actual, or an estimated quantity of fuel furnished by the fuel supply system during the predetermined period of time with the engine's work output during the same period of time. The controller sets a fugitive fueling flag if the furnished quantity of fuel is less than the predicted quantity of fuel. The controller preferably directs the fuel supply system to shut off fuel to the engine if the fugitive fueling flag is set.

According to another embodiment of the invention, in a diagnostic sequence, a controller periodically commands the engine's fuel supply system to change the fuel rate, while determining the engine's resulting change in work output, so as to determine the engine's responsiveness to changes in fuel rate. The controller sets a fugitive fueling flag if the engine's work output does not change in accord with the commanded change in the fuel rate. As an alternative embodiment, the controller may use engine load changes which inherently occur as a basis for determining the presence, if any, of fugitive fueling.

According to another embodiment, the controller directs the fuel supply system to shut off fuel if the fugitive fueling flag is set; the controller thereafter engages an emergency shutdown system if the engine does not stop when the fuel is shut off. The emergency shutdown system includes a rotating electrical machine coupled to the engine, with the rotating electrical machine having sufficient power absorbing capacity to stop the engine.

According to yet another embodiment, an engine output measuring device includes a rotating electrical machine coupled to the engine, with the rotating electrical machine coupled to a variable and controllable load, such that the rotating electrical machine is operated as a dynamometer. This load may be used to bring the engine speed down in case of uncontrolled fugitive fueling, in order to eliminate damage due to either overspeeding or to other internal engine system impairment.

According to another aspect of the present invention, the engine's fuel supply system further includes at least one sensor for directly or indirectly measuring the fuel consumed by the engine during a period of time, with the sensor being coupled to an engine controller.

In another embodiment, a method for detecting and responding to fugitive fueling of a reciprocating internal combustion engine is useful for triggering rapid engine shutdown. This method includes measuring fuel consumed by the engine during a period of time, and determining the engine's work output during the period of time. Then, the method predicts the quantity of fuel which the engine should have consumed during the predetermined period of time, based upon the engine's work output. The actual quantity of fuel consumed during the period of time is compared with predicted fuel consumption, and a fugitive fueling response is initiated the event that the actual quantity of fuel consumed is less than the predicted quantity of fuel. The fugitive fueling response includes the steps of commanding the engine's fuel system either to shut off, or to greatly reduce, the flow of fuel to the engine, and to engage an emergency shutdown system in the event that the engine does not stop in response to the reduction of fuel quantity.

According to another embodiment, if an engine having the present system is coupled to a rotating electrical machine, the engine may be loaded by means by the rotating electrical machine, commonly an alternator, if a command to shut off the fuel does not result in engine shutdown. In such case, a method of loading the engine with an electrical machine may include controlling the field current of the alternator, as well as imposing additional normal and/or auxiliary loads to maintain an increased level of power absorption as the speed of the engine decreases, and placing an adaptive load upon the alternator by means of a traction load. Additional active power absorbing/producing systems could also be used. A traction motor system may be used to control the link voltage applied to the passive load and to at least one traction motor. The alternator field current may be supplied by a bank of continuously firing rectifiers connected with a multi-phase input source. Alternatively, the alternator field current may be supplied by a direct current source. The traction motor may be operated either as a brake or as a motor so as to load the engine and thereby bring it to a stop. This method may also include controlling the alternator field current asynchronously.

According to another aspect of the present invention, a method for operating a reciprocating internal combustion engine having a crankshaft coupled to a traction alternator and at least one traction motor, includes monitoring a plurality of engine operating parameters, and comparing the value of each of said monitored engine operating parameters with a predetermined acceptable range of values. In the event that at least one of the monitored operating parameters falls outside of the acceptable range of values, the traction alternator will be operated with a control voltage provided by a traction motor drive to stop the engine.

The monitored operating parameters useful with the present method include, without limitation, engine coolant temperature; engine lubricating oil temperature; engine lubricating oil pressure; engine lubricating oil level; engine speed; engine vibration level; engine turbocharger speed; engine noise; and engine exhaust emission level.

It is advantage of a system and method according to the present invention that potentially destructive engine operation may be contained before the engine reaches a runaway speed or other damaging condition.

It is a further advantage of a system and method according to the present invention that the inventive system may be implemented without the need of additional hardware in an engine, such as an over-speed governor.

Other advantages, as well as features of the present invention, will become apparent to the reader of this specification.

DETAILED DESCRIPTION OF THE INVENTION

Figure 1:
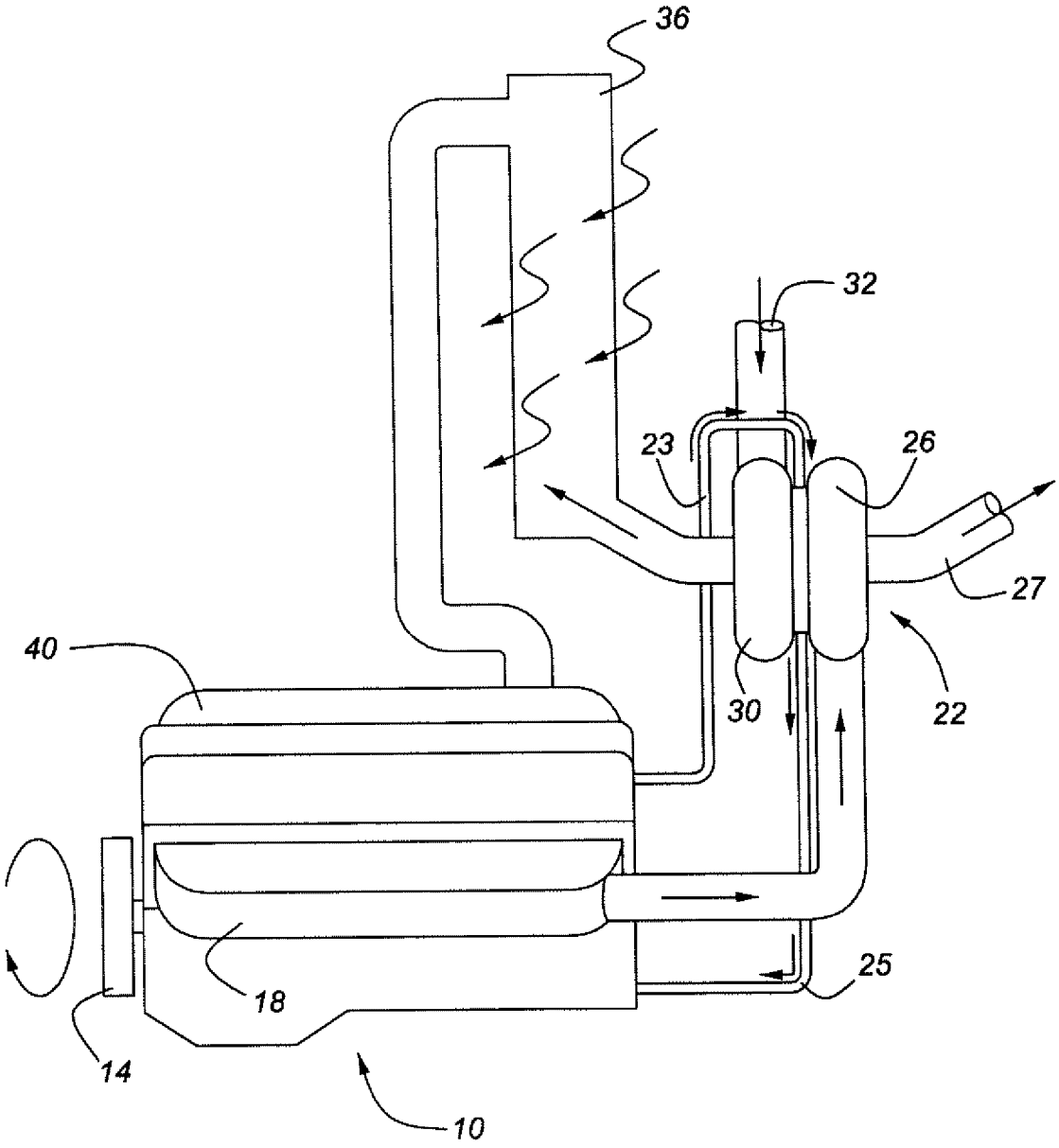
FIG. 1 is a schematic representation of an engine suitable for use with an emergency shutdown system according to an aspect of the present invention.
Figure 2:
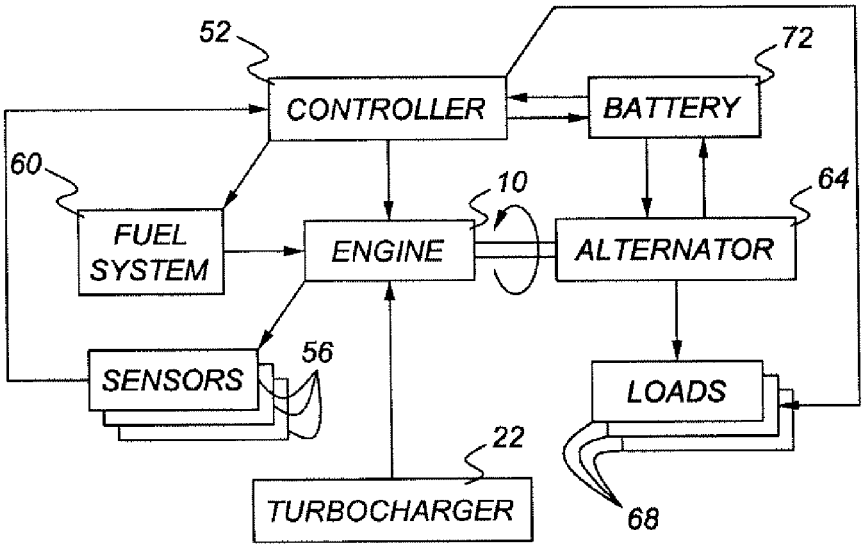
FIG. 2 is a block diagram representing a complete engine system according to an aspect of the present invention.

As shown in the embodiment of FIG. 1, engine 10 has a crankshaft, 14, which is coupled with a load, such as alternator 64 shown in FIG. 2. Engine 10 has an exhaust-driven power adder embodied as turbocharger 22. Exhaust leaving engine 10 through exhaust manifold 18 flows past turbine 26, which drives compressor section 30. Air drawn through air inlet 32 is compressed and flows through aftercooler 36 and then into intake manifold 40. Lubricating oil flows to turbocharger 22 through line 23 and returns to the engine through line 25.

FIG. 2 shows an embodiment of engine fuel system 60, which is operated by controller 52. Fuel system 60 may include either a common rail injection setup, or camshaft-driven unit injectors, or yet other types of fuel systems known to those skilled in the art and suggested by this disclosure. Controller 52 is also connected with battery 72, which, in the case of a locomotive, may be either a traction battery, or other type of battery such as a starting battery or control system battery. Engine 10 powers alternator 64 in the present example, such as would be the case where engine 10 is installed in a diesel-electric locomotive. Alternator 64 has a number of loads, 68, attached thereto, which may include traction motors, dynamic brake grids, or other devices. Sensors 56 include sensors for various operating parameters such as engine speed, turbocharger speed, fuel flow, engine temperature, various system current flow rates and voltages, and other operating parameters known to those skilled in the art and suggested by this disclosure.

Figure 3:
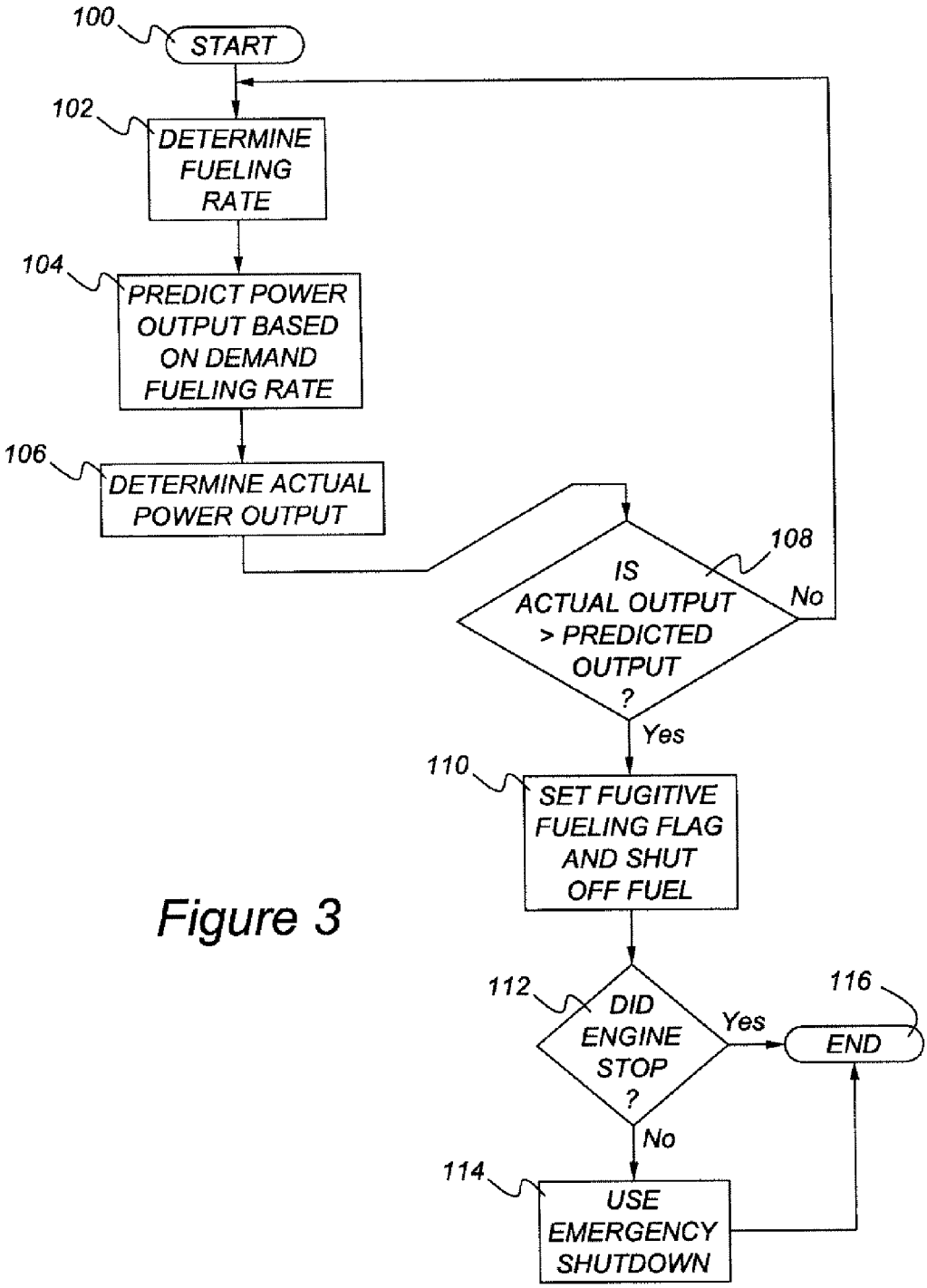
FIG. 3 is a flow diagram illustrating a diagnostic method useful for triggering operation of an emergency shutdown system according to an embodiment of the present invention.

FIG. 3 illustrates an embodiment of a method useful for triggering the present control scheme. Beginning at block 100 with a start command, the method moves to block 102, wherein the fueling rate of the engine 10 is determined. Fuel rate is known from fuel system 60, which normally includes at least one fuel injector for furnishing fuel to the engine. More probably, a separate fuel injector will be employed for each cylinder, with the precise quantity of fuel per injector stroke being controlled by controller 52. Because controller 52 is operatively connected with fuel system 60, controller 52 is well-suited to determine the exact amount of fuel being delivered to engine 10 at any particular period of time.

The determination of fuel quantity delivered to the engine's cylinders by the fuel system could also be done by using an estimate based on injector opening time, as well as upon the shape of the injector map. Speed regulator controller effort could also be employed for this purpose. The precision of the estimated fuel consumption value may be improved by correcting for ambient air pressure and temperature according to the formula $1/(((0.0005386*T)+0.96768)*(14.135/P)^{0.093}$, where T is the temperature is degrees F., and P is the absolute pressure in pounds per square inch. Additional compensation could be based on the energy content of the fuel.

After block 102, the method continues with block 104, wherein power output is predicted as a function of the previously determined fuel rate. The power output is predicted according to models or by a lookup table, or yet other methods known to those skilled in the art and suggested by this disclosure. Such lookup tables or analytical methods may include various factors such as trending/history (prior performance of the system at the same or comparable operating conditions) or operation of similarly designed systems.

After determining the predicted power output at block 104, the method moves to block 106, wherein the actual power output of engine 10 is determined. To do this, alternator 64 may be operated as a virtual dynamometer. In other words, knowing the operating parameters of alternator 64, such as rotational speed and alternator field current, it is possible for controller 52 to determine the precise power output of the engine 10. Another option is to monitor the output power by measuring the output voltage and current. Of course, power and work are related by time, and work output of engine 10 is merely time integrated sum of its power output.

At block 108, the method compares the actual output of engine 10 with the predicted output of the engine. In the event that the actual power output, or work, is not greater than the predicted output, the routine recycles to block 102. If, however, the actual output is greater than the predicted output at block 108, the routine moves to block 110, wherein a fugitive fueling flag is set and controller 52 commands fuel system 60 to shut off fuel to the engine. The comparison at block 108 may include thresholds or tolerances to account for inaccuracies in the data underlying the comparison. Moreover, transient capability could be part of the comparison. In essence, at block 108 the method determines whether fugitive fueling is present.

The method looks to see whether engine 10 has stopped at block 112. If engine 10 did stop, the method concludes at block 116. If, however, engine 10 is not stopped at block 112, the method moves to block 114, where emergency shutdown procedures are initiated in response to the fugitive fueling flag. With certain engines, it may be desirable at block 110 to reduce fuel flow to an idle value, rather than to cut off the flow altogether. With other engines, emergency shut down procedures may be initiated simultaneously with the fuel shut off command.

Those skilled in the art will appreciate in view of this disclosure that the method disclosed in FIG. 3 is merely exemplary of a class of methods in which an engine operating parameter is compared with a predetermined range, with emergency shutdown being ordered in the event that the measured parameter lies outside of the desired range. For example, if engine temperature exceeds a predetermined threshold, or if engine oil pressure is less than a predetermined threshold, immediate engine shutdown may be indicated.

In the event that an emergency stop is indicated, engine 10 is loaded with alternator 64 to quickly bring the engine to a halt by controlling the field current of alternator 64, as well as the load imposed upon the alternator, adaptively, so as to maintain power absorption at a high level as the speed of engine 10 decreases. The adaptive load is placed on the alternator by using both a passive load and a traction motor system. A traction motor drive may be employed to control the link voltage, which is applied to the passive load and to the traction motor. The alternator field current may be supplied by a bank of continuously firing rectifiers connected with a multi-phase input source, or with a direct current source. If this mode of emergency shutdown is used, traction motors, such as in a diesel electric locomotive or other large electro-drive vehicle, may be employed as either a brake or a motor.

Figure 4:
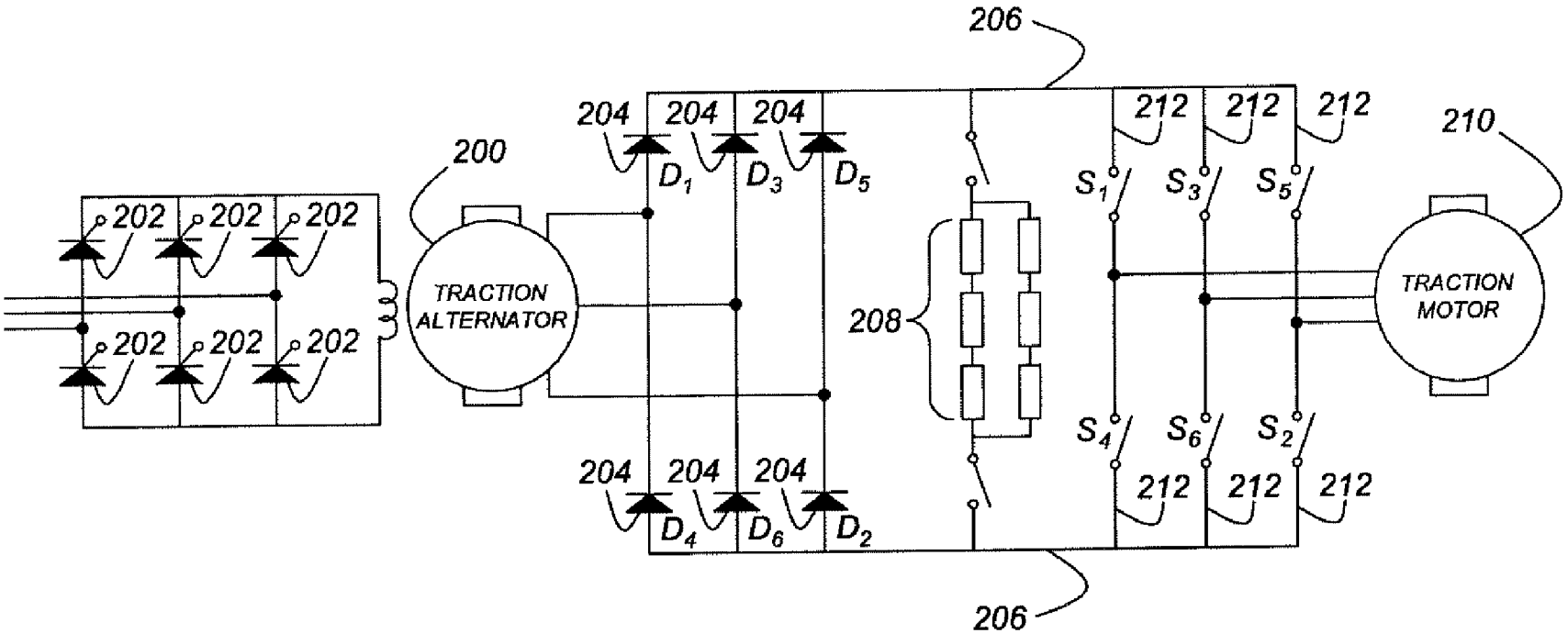
FIG. 4 illustrates a typical traction drive which is useful in an emergency shutdown system according to one aspect of the present invention.

FIG. 4 shows a typical traction drive used in heavy haul applications such as locomotives and mining equipment. Alternator 200 is directly driven by engine 10 (not shown). The alternator field is controlled by phase controlled rectifiers (AC to DC converters) 202. The output of alternator 200, which is rectified by rectifiers 204, supplies DC bus 206. Resistor bank 208, connected to bus 206, is used to dissipate braking energy. A traction motor drive, including AC motor 210, is also connected to DC bus 206.

Figure 8:
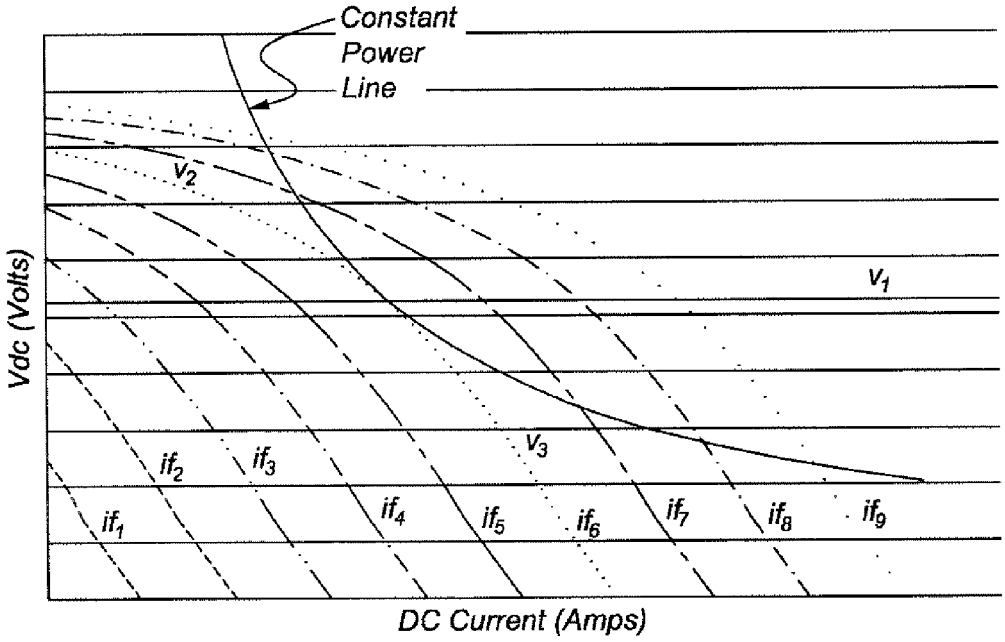
FIG. 8 illustrates several of the operating characteristics of an alternator useful for practicing certain aspects of the present invention.

FIG. 8 illustrates various alternator system operating characteristics. Voltage/current characteristics for different alternator field currents (if1, if2 . . . if9) are shown. A constant power line is also shown. In the example of FIG. 8, the maximum power can be transmitted when the DC link voltage is at level v1, for a given field current of $if_6$. If the voltage is above or below this level, the power delivered by the alternator, and therefore, the torque applied to bring the engine speed down, is reduced. Various methods can be used to control the power. The first method is by controlling the alternator field current. Generally, the higher the field current, the greater the power transfer. In general, this method has a slower response characteristic due to the large inductance typically present in the field. Moreover, the phase controlled rectifier control generally loses synchronization if the input frequency changes too fast. This generally happens if the engine is slowing down quickly. Therefore, in the emergency shutdown mode, SCRs 202 are continuously fired (without regard to synchronization) until the maximum field current is produced. The power transfer is maximized by optimizing the DC link voltage. Resistor bank 208 is connected to DC bus 206.

The DC link voltage can be controlled by choppers (not shown). Typically, however, choppers are not used because a DC signal is available to control the link voltage. In such case, and even if choppers are used, the traction inverters are used to control the maximum power transfer. For example, when resistor bank 208 and traction motor 210 are connected, if the operating point is at v2 in FIG. 8, then traction motor drives $S_1$-$S_6$ (shown at 212 in FIG. 4) are controlled so that motor 210 transiently produces more motoring torque, so as to bring the DC link voltage from v2 to v1. Because the time required to bring the engine speed to an acceptable level is less than a few seconds and may be even fraction of second, the effect of transient traction load is minimal. On the other hand, if the operating voltage is v3, then the traction load is reduced so as to bring the voltage to v1 from v3. In some cases, traction motor 210 may have to be driven even into braking. In this case, resistor bank 208 will dissipate the power from the engine driving alternator 200, as well as the power from the traction motor.

Figure 5:
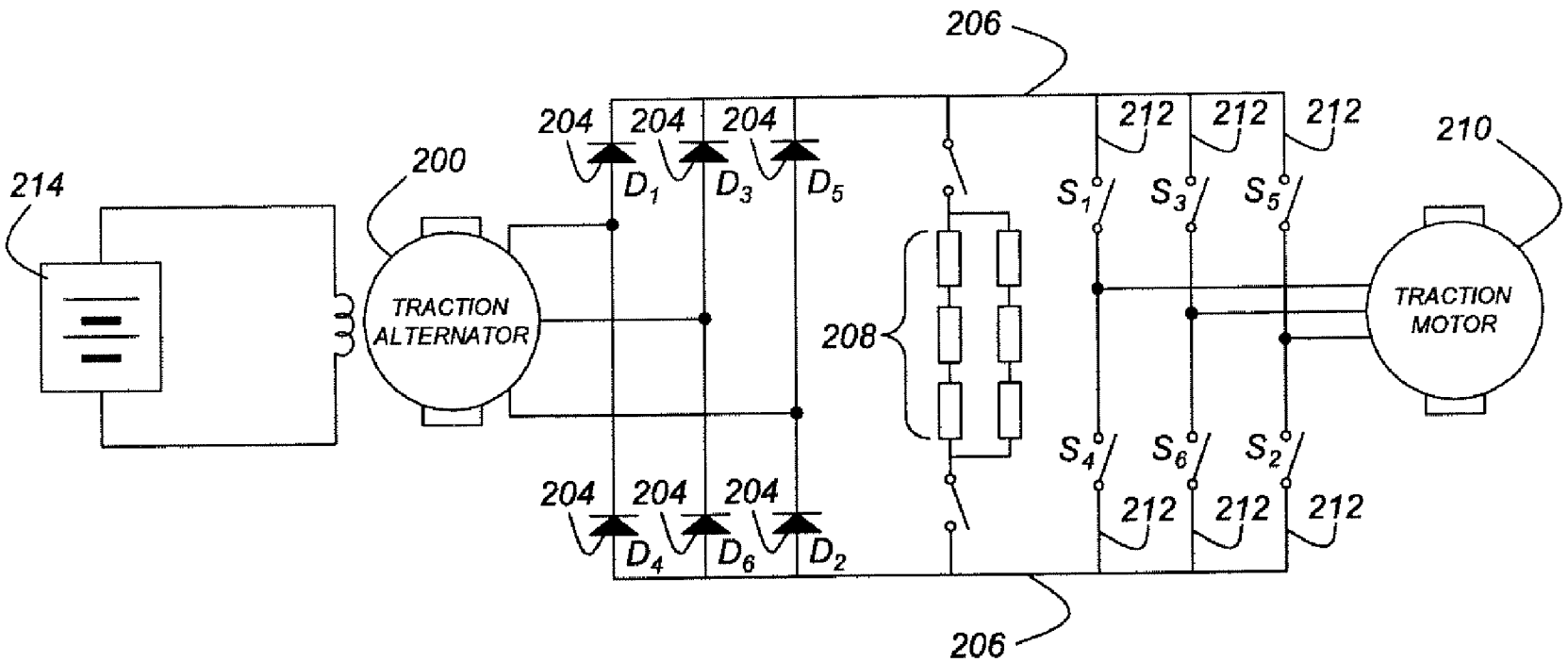
FIG. 5 is similar to FIG. 4, but shows a DC source for an alternator field current control according to an aspect of the present invention.

FIG. 5 shows a similar system to that of FIG. 4, except that the field control is replaced by a DC source, 214. Although a battery is shown, any DC source could be used.

Figure 6:
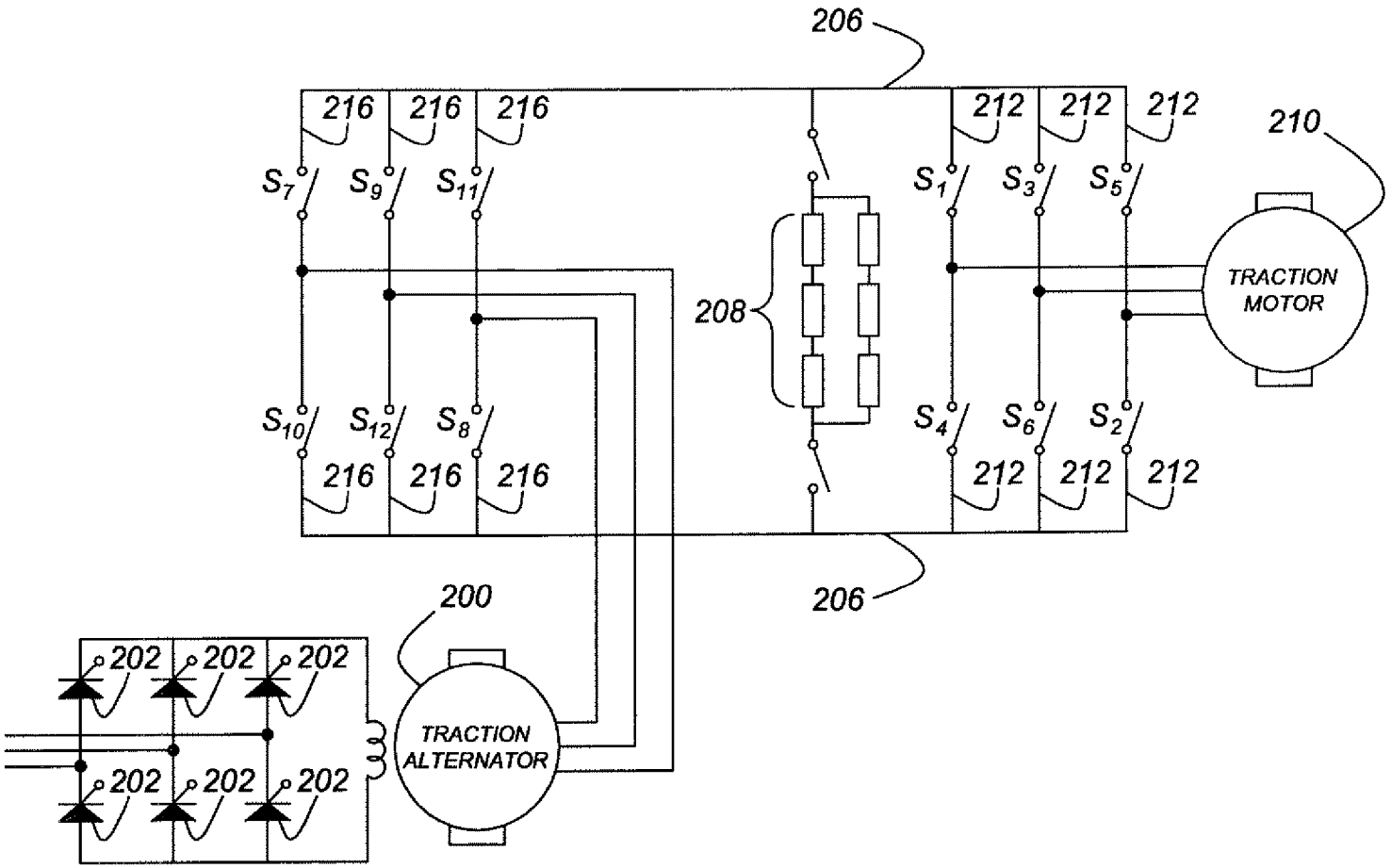
FIG. 6 illustrates another embodiment for using an alternator to load an engine during an emergency shutdown.

FIG. 6 shows another method for controlling the power transfer through an alternator/traction motor system. In this case, unlike FIGS. 4 and 5, the alternator output is connected to a controlled rectifier (either step down—using a phase controlled rectifier if the DC link voltage needs to be brought down or a 3 phase pulse width modulated rectifier if the DC link voltage needs to be increased). In this case, when the DC link voltage is changed, the power consumed by the resistor bank 208 and the power flow from alternator 200 is also changed. In this configuration, resistor bank 208 and its control, the traction motor drive, the alternator output rectifier and the alternator field current could all be controlled to get the maximum power transfer from alternator 200 so as to bring the engine speed down as fast as possible. The engine can be brought down to very low speeds and can even be driven in the opposite direction.

Figure 7:
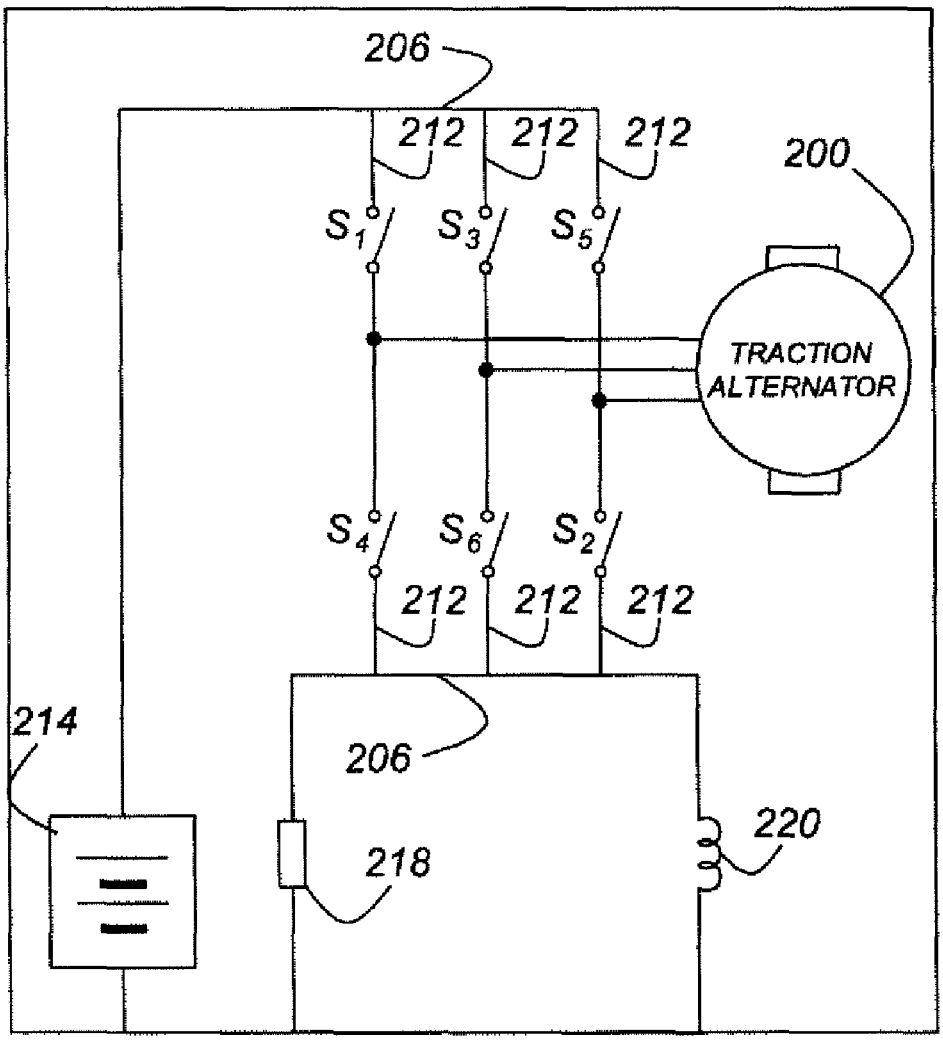
FIG. 7 illustrates use of a traction inverter to regulate dc link voltage according to another aspect of the present invention.

As the engine speed comes down, the traction inverter, or any other AC source, such as another inverter, could be used to regulate the DC link voltage through a circuit represented by resistor 218 and inductor 220, with the alternator inverter being controlled to produce the maximum torque. This operation is very similar to engine cranking operation as described in U.S. Pat. Nos. 4,585,983 and 6,023,137. This type of control, as shown in FIG. 7, can be used to generate and control high torques at low speeds. This can also be used to bring the engine speed to 0.

The quick shutdown capability afforded by alternator 200, either with or without assistance from traction motor 210, may be used in case of engine impairment, or abnormal operating conditions other than fugitive fueling. Such impairment, as well as unwanted operating conditions having the potential for causing engine damage could be detected by monitoring such engine operating parameters as turbocharger speed, turbocharger inlet temperature, intake manifold temperature, intake manifold pressure, exhaust temperature, oil pressure and/or temperature and/or flow, fuel pump operation, fuel pressure/flow, fuel injector and control operation, engine speed, crankcase pressure, coolant flow, coolant temperature, vibration, and other operating parameters. Each monitored parameter may be compared with a predetermined acceptable range, as disclosed in the method of FIG. 3, with the rapid stopping procedure being initiated in the event that the monitored parameter, or group of parameters, falls outside an established range.

While particular embodiments of the invention have been shown and described, numerous variations and alternate embodiments will occur to those skilled in the art. Accordingly, it is intended that the invention be limited only in terms of the appended claims.

The invention claimed is:

1. A method for rapidly stopping an internal combustion engine having an output shaft coupled to a rotating electrical machine, comprising:

detecting an engine operating condition indicating that the engine should be shut down; and operating said rotating electrical machine as a virtual dynamometer to adaptively load the engine, so as to provide sufficient torque to rapidly stop the engine.

2. The method of claim 1, wherein said rotating electrical machine comprises an alternator, and loading the engine with the rotating electrical machine comprises:

controlling a field current of the alternator to maintain maximum power absorption as the speed of the engine decreases; and placing an adaptive load upon the alternator.

3. The method of claim 2, wherein said alternator field current is supplied by a bank of continuously firing rectifiers connected with a multiphase input source.

4. The method according of claim 2, wherein said alternator field current is supplied by a direct current source.

5. The method of claim 2, wherein an adaptive load is placed upon said alternator by applying both a passive load and a load provided by a traction motor system, while using a traction motor drive to control a link voltage applied to the passive load and to at least one traction motor.

6. The method of claim 5, wherein said traction motor is operated as a brake.

7. The method of claim 5, wherein said traction motor is operated as a motor.

8. The method of claim 2, wherein said field current is controlled asynchronously.

9. The method of claim 1, further comprising shutting off fuel to the engine.

10. The method of claim 1, wherein said engine comprises a reciprocating internal combustion engine.

11. The method of claim 1, wherein said engine comprises a reciprocating internal combustion engine installed in a railroad locomotive.

12. A method for operating a reciprocating internal combustion engine having a crankshaft coupled to a traction alternator and at least one traction motor, said method comprising:

monitoring a plurality of engine operating parameters;

comparing the value of each of said monitored engine operating parameters with a predetermined acceptable range of values; and in the event that at least one of said monitored operating parameters falls outside of said acceptable range of values, operating said traction alternator with a load imposed by a traction motor and a traction motor control system, so as to stop said engine.

13. The method of claim 12, wherein said monitored operating parameter comprises at least one of: engine coolant temperature; engine lubricating oil temperature; engine lubricating oil pressure; engine lubricating oil level; engine speed; engine vibration level; engine turbocharger speed; engine noise; and engine exhaust emission level.

14. The method of claim 12, wherein said alternator is operated with a control voltage provided by a traction motor drive to stop said engine.

15. The method of claim 12, wherein said internal combustion engine and said alternator are incorporated within a railroad locomotive.

16. A system for operating a reciprocating internal combustion engine having a crankshaft coupled to a traction alternator and at least one traction motor, with said system comprising:

a plurality of sensors for monitoring a plurality of engine operating parameters;

a controller operatively connected with said plurality of sensors, with said controller comparing the value of each of said monitored engine operating parameters with a predetermined acceptable range of values; and with said controller operating said traction alternator adaptively with a load imposed by said traction motor so as to stop said engine if at least one of said monitored operating parameters falls outside of said acceptable range of values.

* * * * *